US010697116B2

(12) United States Patent
Nuopponen et al.

(10) Patent No.: US 10,697,116 B2
(45) Date of Patent: Jun. 30, 2020

(54) METHOD FOR PRODUCING NANOFIBRILLAR CELLULOSE AND NANOFIBRILLAR CELLULOSE PRODUCT

(71) Applicant: UPM-KYMMENE CORPORATION, Helsinki (FI)

(72) Inventors: Markus Nuopponen, Helsinki (FI); Juha Tamper, Levanen (FI); Isko Kajanto, Espoo (FI)

(73) Assignee: UPM-KYMMENE CORPORATION, Helsinki (FI)

( * ) Notice: Subject to any disclaimer, the term of this patent is extended or adjusted under 35 U.S.C. 154(b) by 246 days.

(21) Appl. No.: 15/125,343

(22) PCT Filed: Mar. 27, 2015

(86) PCT No.: PCT/FI2015/050216

§ 371 (c)(1),
(2) Date: Sep. 12, 2016

(87) PCT Pub. No.: WO2015/150628

PCT Pub. Date: Oct. 8, 2015

(65) Prior Publication Data

US 2017/0211230 A1 Jul. 27, 2017

(30) Foreign Application Priority Data

Mar. 31, 2014 (FI) ..... 20145298

(51) Int. Cl.
*D21B 1/14* (2006.01)
*D21H 11/18* (2006.01)
*D21D 1/36* (2006.01)

(52) U.S. Cl.
CPC ..... *D21B 1/14* (2013.01); *D21D 1/36* (2013.01); *D21H 11/18* (2013.01)

(58) Field of Classification Search
CPC ..... D21H 11/18; D21H 11/20; D21D 1/20; D21D 1/36; D21D 1/004; D21D 1/30; D21B 1/12; D21B 1/06; D21B 1/063; D21B 1/14; D21B 1/16; D21B 1/30; B82Y 30/00
See application file for complete search history.

(56) References Cited

U.S. PATENT DOCUMENTS 6,202,946 B1 * 3/2001 Virtanen ..... B02C 13/205 241/21
9,809,655 B2 * 11/2017 Laukkanen ..... C08B 15/04
10,113,006 B2 * 10/2018 Rissanen ..... C08B 3/20
2012/0043039 A1 * 2/2012 Paltakari ..... D21H 11/18 162/157.6
2013/0000855 A1 * 1/2013 Nuopponen ..... D21H 11/18 162/76
2013/0017394 A1 * 1/2013 Hua ..... D21D 1/20 241/28
2013/0345416 A1 * 12/2013 Laukkanen ..... B01J 13/0069 536/85
2014/0058077 A1 * 2/2014 Laukkanen ..... B82Y 30/00 536/56
2014/0083634 A1 * 3/2014 Bjoerkqvist ..... D21D 1/20 162/28
2014/0110070 A1 * 4/2014 Vuorinen ..... C08B 15/04 162/60
2014/0114059 A1 * 4/2014 Tamper ..... D21C 9/005 536/56
2014/0124150 A1 * 5/2014 Sabourin ..... D21C 9/001 162/9
2014/0284407 A1 * 9/2014 Tamper ..... D21D 1/36 241/21
2014/0374045 A1 * 12/2014 Nuopponen ..... D21C 9/007 162/181.2
2015/0034263 A1 * 2/2015 Nuopponen ..... C08L 1/04 162/57
2015/0045549 A1 * 2/2015 Laukkanen ..... C08L 1/02 536/85
2015/0299955 A1 * 10/2015 Laukkanen ..... C08B 15/00 162/9
2015/0337493 A1 11/2015 Meiskanen et al.
2016/0102433 A1 * 4/2016 Nuopponen ..... D21D 1/004 162/28

(Continued)

FOREIGN PATENT DOCUMENTS

CA 2910576 A1 * 11/2014 ..... D21H 21/02
CN 1424332 A 6/2003

(Continued)

OTHER PUBLICATIONS

International Search Report dated Jun. 17, 2015; International Application No. PCT/FI2015/050216; International Filing Date Mar. 27, 2015 (4 pages).

(Continued)

*Primary Examiner* — Jose A Fortuna
(74) *Attorney, Agent, or Firm* — Cantor Colburn LLP

(57) ABSTRACT

In a method for producing nanofibrillar cellulose, cellulose based fibre material, in which internal bonds in cellulose fibres have been weakened by preliminary modification of cellulose, is subjected to disintegration treatment in form of pulp comprising fibres and liquid. The fibre material is supplied at a consistency higher than 10 wt-%, preferably at least 15 wt-%, to a disintegration treatment where fibrils are detached from the fibre material by joint effect of repeated impacts to the fibre material by fast moving successive elements and the weakened internal bonds of the cellulose fibres. The nanofibrillar cellulose is withdrawn from the disintegration treatment at dry matter which is equal or higher than the consistency of the fibre material. In the disintegration treatment, the fibre material is supplied through several counter-rotating rotors (R1, R2, R3 . . . ) outwards in the radial direction with respect to the rotation axis (RA) of the rotors in such a way that the material is repeatedly subjected to shear and impact forces by the effect of the blades (1) of the different counter-rotating rotors.

14 Claims, 2 Drawing Sheets

(56) References Cited

U.S. PATENT DOCUMENTS

| | | | | |
|---|---|---|---|---|
| 2016/0122947 | A1* | 5/2016 | Kajanto | D21H 21/02 162/146 |
| 2016/0299119 | A1* | 10/2016 | Laukkanen | D21H 11/18 |
| 2017/0107666 | A1* | 4/2017 | Kajanto | D21D 1/20 |
| 2017/0210826 | A1* | 7/2017 | Nelson | D21C 1/02 |
| 2018/0024121 | A1* | 1/2018 | Yliperttula | G01N 33/5008 506/10 |
| 2018/0094081 | A1* | 4/2018 | Nuopponen | A61K 31/717 |
| 2019/0111175 | A1* | 4/2019 | Luukko | A61L 15/14 |
| 2019/0292727 | A1* | 9/2019 | Backfolk | D21H 13/04 |

FOREIGN PATENT DOCUMENTS

| | | | | |
|---|---|---|---|---|
| CN | 1668646 | A | 9/2005 | |
| CN | 101994271 | A | 3/2011 | |
| CN | 102317542 | A1 | 1/2012 | |
| EP | 0859011 | A1 | 8/1998 | |
| EP | 2236545 | A1 * | 10/2010 | B82Y 30/00 |
| FR | 2730251 | A1 * | 8/1996 | C09K 8/206 |
| GB | 891152 | A | 3/1962 | |
| GB | 995464 | A | 6/1965 | |
| JP | 2013203859 | A | 10/2013 | |
| WO | WO-9829596 | A1 * | 7/1998 | B02C 13/205 |
| WO | 9856981 | A | 12/1998 | |
| WO | 2004055268 | A1 | 7/2004 | |
| WO | WO-2004055267 | A1 * | 7/2004 | C08L 1/02 |
| WO | WO-2004055268 | A1 * | 7/2004 | D21J 3/00 |
| WO | 2010092239 | A1 | 8/2010 | |
| WO | WO-2010092239 | A1 * | 8/2010 | D21H 11/18 |
| WO | 2011004301 | | 1/2011 | |
| WO | 2011056130 | A1 | 5/2011 | |
| WO | 2011089323 | A1 | 7/2011 | |
| WO | 2012097446 | A1 | 7/2012 | |
| WO | 2012168562 | | 12/2012 | |
| WO | 2012172170 | A1 | 12/2012 | |
| WO | WO-2012172170 | A1 * | 12/2012 | D21C 9/005 |
| WO | 2013072559 | A1 | 5/2013 | |
| WO | 2013076376 | | 5/2013 | |
| WO | WO-2013072559 | A1 * | 5/2013 | D21D 1/36 |
| WO | 2013121086 | A1 | 8/2013 | |
| WO | WO-2014184438 | A1 * | 11/2014 | D21D 1/004 |
| WO | 2013047218 | A1 | 3/2015 | |
| WO | WO-2015082774 | A1 * | 6/2015 | D21C 5/005 |
| WO | WO-2015150628 | A1 * | 10/2015 | D21D 1/36 |
| WO | 2014024876 | A1 | 7/2016 | |

OTHER PUBLICATIONS

Written Opinion dated Jun. 17, 2015; International Application No. PCT/FI2015/050216; International Filing Date Mar. 27, 2015 (5 pages).

* cited by examiner

■ REF

▲ Comparative Example

+ Example 1

♦ Example 2

METHOD FOR PRODUCING NANOFIBRILLAR CELLULOSE AND NANOFIBRILLAR CELLULOSE PRODUCT

CROSS-REFERENCE TO RELATED APPLICATIONS

This application is a National Stage application of PCT/FI2015/050216, filed Mar. 27, 2015, which claims priority of Finnish Application No. FI20145298, filed Mar. 31, 2014, both of which are incorporated by reference herein in their entirety.

FIELD OF THE INVENTION

The invention relates to a method for producing nanofibrillar cellulose, wherein cellulose based fibre material is comminuted for separating fibrils. The invention also relates to nanofibrillar cellulose product.

BACKGROUND OF THE INVENTION

In the refining of lignocellulose-containing fibres by, for example, a disc refiner or a conical refiner at a low consistency of about 3 to 4%, the structure of the fibre wall is loosened, and fibrils or so-called fines are detached from the surface of the fibre. The formed fines and flexible fibres have an advantageous effect on the properties of most paper grades. In the refining of pulp fibres, however, the aim is to retain the length and strength of the fibres. In post-refining of mechanical pulp, the aim is partial fibrillation of the fibres by making the thick fibre wall thinner by refining, for detaching fibrils from the surface of the fibre.

Lignocellulose-containing fibres can also be disintegrated into smaller parts by detaching fibrils which act as components in the fibre walls, wherein the particles obtained become significantly smaller in size. The properties of so-called nanofibrillar cellulose thus obtained differ significantly from the properties of normal pulp. It is also possible to use nanofibrillar cellulose as an additive in papermaking and to increase the internal bond strength (interlaminar strength) and tensile strength of the paper product, as well as to increase the tightness of the paper. Nanofibrillar cellulose also differs from pulp in its appearance, because it is gel-like material in which the fibrils are present in water dispersion. Because of the properties of nanofibrillar cellulose, it has become a desired raw material, and products containing it would have several uses in industry, for example as an additive in various compositions.

Nanofibrillar cellulose can be isolated as such directly from the fermentation process of some bacteria (including *Acetobacter xylinus*). However, in view of large-scale production of nanofibril cellulose, the most promising potential raw material is raw material derived from plants and containing cellulose fibres, particularly wood and fibrous pulp made from it. The production of nanofibrillar cellulose from pulp requires the decomposition of the fibres further to the scale of fibrils. In processing, a cellulose fibre suspension is run several times through a homogenization step that generates high shear forces on the material. This can be achieved by guiding the suspension under high pressure repeatedly through a narrow gap where it achieves a high speed. It is also possible to use refiner discs, between which the fibre suspension is introduced several times.

International application PCT/FI2012/051116 (publication WO 2013/072559) shows a method where fibre material is introduced through several counter-rotating rotors in such a way that the material is repeatedly subjected to shear and impact forces by the effect of the different counter-rotating rotors while it flows outwards radially with respect to the rotors. Fibre material is made to nanofibrillar cellulose by feeding it at low consistency (1.5%-4.5%) through the rotors. The cellulose fibres used in this method as starting material are chemically modified so that the cellulose molecules have functional side groups which cause the weakening of the internal bonds in the cellulose fibre to facilitate the separation of fibrils. Catalytic oxidation and carboxymethylation are known chemical modification methods.

Conventionally the pulp is disintegrated to nanofibrillar cellulose at low consistency to guarantee good efficiency. This results in nanofibrillar cellulose in form of aqueous gel which has about the same nanofibril concentration as expressed in wt-%, that is, the nanofibrillar cellulose contains a great amount of water. Dewatering of nanofibrillar cellulose gels to increase the dry matter content has proved difficult. On the other hand, the pulp cannot be disintegrated to nanofibrillar cellulose at higher consistencies because the formation of fibrils remains poor and characteristic gel with high zero shear viscosity is not obtained. Thus, the production of large volumes of nanofibrillar cellulose is uneconomical because of the low production consistency.

BRIEF SUMMARY OF THE INVENTION

It is an aim of the invention to eliminate the above-mentioned drawbacks and to present a method by which nanofibril cellulose can be made with a good capacity and also at a higher consistency.

In the method, cellulose based fibre material, in which internal bonds in the cellulose fibre have been weakened by chemical modification to a high degree, are used as starting material. The said starting material is subjected to the action of counterrotating rotors as an aqueous suspension of the fibres, pulp, that exists at a high consistency, and the material at this consistency is repeatedly impacted by the blades of the rotors. In the course of these repeated impacts, the direction of impacts varies as the rotors rotate in opposite directions.

It was found unexpectedly that cellulose based fibre material can be disintegrated at pulp consistencies higher than usual to nanofibrillar cellulose that behaves like gel and has typical high zero shear viscosity and shear thinning properties when diluted in water. The disintegration treatment is performed by using impacts to the fibre material caused by counter-rotating rotors of the disintegrating device. This is made possible by a high degree of chemical modification of the cellulose in the fibre material, expressable as the content of functional groups of the cellulose molecules or degree of substitution of the cellulose molecules.

The consistency of the fibre based starting material where the cellulose is chemically modified is higher than 10 wt-%, preferably at least 15 wt-%. The disintegration treatment is performed in the conditions where water is sufficiently present to prevent the formation of bonds between the fibres. The consistency is preferably higher than 10% and 50% at the most, more preferably in the range of 15-40% and most preferably 15-30%.

The cellulose in the fibre starting material is physically modified, enzymatically modified or chemically modified cellulose. In physical modification, anionic, cationic or non-ionic substances are physically adsorbed on cellulose surface. In chemical modification, the chemical structure of the cellulose molecule is changed by chemical reaction ("derivatization") of cellulose.

The cellulose can be especially ionically charged after the modification, because the ionic charge of the cellulose weakens the internal bonds of the fibers and will later facilitate the disintegration to nanofibrillar cellulose. The ionic charge can be achieved by chemical or physical modification of cellulose. The fibers have higher anionic or cationic charge after the modification compared with the starting material.

One preferred chemical modification method is the oxidation of cellulose, in which anionically charged cellulose is obtained. In the oxidation of cellulose, the primary hydroxyl groups of cellulose are oxidized catalytically by a heterocyclic nitroxyl compound, for example 2,2,6,6-tetramethylpiperidinyl-1-oxy free radical, "TEMPO". The hydroxyl groups are oxidized to carboxyl groups. Depending on the method steps, part of the oxidized hydroxyl groups can be aldehyde groups.

Another chemical modification method for obtaining anionic charge is carboxymethylation, where carboxymethyl groups are attached to cellulose molecules. A cationic charge in turn can be created chemically by cationization, where cationic groups, such as quaternary ammonium groups, are attached to cellulose molecules.

As to the high modification degree, the pulp modified by catalytic oxidation has carboxylate content of at least 0.8 mmol/g or higher, preferably at least 0.95 mmol/g or higher, and most preferably at least 1.00 mmol/g or higher, based on dried pulp. The carboxylate content is preferably in the range of 0.8-1.8, more preferably 0.95-1.65 and most preferably 1.00-1.55 mmol/g pulp.

In the case of carboxymethylated cellulose, the degree of substitution is above 0.1, preferably at least 0.12 or higher. The degree of substitution is preferably in the range of 0.12-0.2. In the case of cationized cellulose, the degree of substitution is at least 0.1 or higher, preferably at least 0.15 or higher. The degree of substitution is preferably in the range of 0.1-0.6, more preferably 0.15-0.35 in the cationized cellulose.

The starting material, pulp, where the cellulose is chemically modified can be characterized by high degree of substitution or high content of chemical groups (high modification degree), which makes it possible to disintegrate the pulp by simple means at unusually high consistency to nanofibrillar cellulose, which has the typical properties of gel with high zero-shear viscosity and shear thinning behaviour, when diluted to the concentration of 1-2 wt-% in water.

The properties of the nanofibrillar cellulose can vary within wide boundaries, depending on the conditions of the disintegration treatments and the number of runs through the treatment. The zero-shear viscosity ("plateau" of constant viscosity at small shearing stresses approaching zero) of the nanofibrillar cellulose measured with a stress controlled rotational rheometer at a concentration of 0.5% (aqueous medium) is typically between 1000 and 50000 Pa·s, preferably 5000 and 50000 Pa·s. The yield stress of the NFC determined by the same method is between 1 and 50 Pa, preferably in the range of 3-20 Pa, most preferably 6-15 Pa.

In the method of producing nanofibrillar cellulose from fibre material, there is always water present in the fibre material in larger proportion as the fibres, expressed as dry matter, in every stage of the disintegration treatment. Even though the dry matter content of the fibre material may rise during the disintegration treatment, the method cannot be regarded as dry refining method.

When the fibre material of the high consistency pulp is disintegrated to the level of fibrils in a device comprising a series of counterrotating rotors, the suspension of fibre material is repeatedly impacted by the blades or ribs of the rotors striking it from opposite directions when the blades rotate at the rotating speed and at the peripheral speed determined by the radius (distance to the rotation axis) in opposite directions. Because the fibre material is transferred outwards in the radial direction, it crashes onto the wide surfaces of the blades, i.e. ribs, coming one after each other at a high peripheral speed from opposite directions; in other words, it receives several successive impacts from opposite directions. Also, at the edges of the wide surfaces of the blades, i.e. ribs, which edges form a blade gap with the opposite edge of the next rotor blade, shear forces occur, which contribute to the fibrillation (detaching of the fibrils form the fibres).

Furthermore, the fibrillation works well when the pH of the fibre suspension is in the neutral or slightly alkaline range (pH 6 to 9, advantageously 7 to 8). An elevated temperature (higher than 30° C.) also contributes to the fibrillation. With respect to the temperature, the normal operating environment for processing is usually 20 to 70° C. The temperature is advantageously between 35 and 60° C.

On the periphery of each rotor, there are several blades which, together with several blades of the preceding and/or next rotor in the radial direction, because of their rotary movement in opposite directions, repeatedly produce several narrow blade spaces or gaps, in which the fibres are also subjected to shear forces as the opposite edges of the blades, i.e. ribs, pass each other at a high speed when moving into opposite directions. By the arrangement of the series of rotors with alternating rotating directions and the distribution of the blades on peripheries of the rotors, impacts coming at a high frequency from different directions can be achieved.

It can be stated that in each pair of counter-rotating rotors, a large number of narrow blade gaps and, correspondingly, reversals of impact directions, are generated during a single rotation of each rotor, the recurrence frequency being proportional to the number of blades i.e. ribs on the periphery. Consequently, the direction of impacts caused by the blades i.e. ribs on the fibre material is changed at a high frequency. The number of blade gaps during the rotations and their recurrence frequency depend on the density of the blades distributed onto the periphery of each rotor, and correspondingly on the rotation speed of each rotor. The number of such rotor pairs is n−1, where n is the total number of rotors, because one rotor always forms a pair with the next outer rotor in the radial direction, except for the outermost rotor, through which the processed pulp exits the refining process.

Different rotors may have different numbers of blades i.e. ribs, for example in such a way that the number of blades increases in the outermost rotors. The number of blades i.e. ribs can also vary according to another formula.

The density of the blades/ribs on the periphery of each rotor, as well as the angles of the blades to the radial direction, as well as the rotation speeds of the rotors can be used to affect the refining efficiency (the refining intensity) as well as the throughput time of the fibre material to be refined.

The supplying can be implemented so that the mixture to be passed through the rotors contains a given volume part of a gaseous medium mixed in it, but as a separate phase, for example greater than 10 vol. %. For intensifying the separation of the fibrils, the content of gas is at least 50 vol. %, advantageously at least 70% and more advantageously between 80 and 99%; that is, expressed in degrees of filling (the proportion of the fibre suspension to be processed in the volume passing through the rotor) lower than 90 vol. %, not higher than 50%, not higher than 30% and correspondingly between 1 and 20%. The gas is advantageously air, wherein the fibre suspension to be processed can be supplied in such a way that a given proportion of air is admixed to the fibre suspension. The air, whether at room temperature (20-25° C.) or at elevated temperature, will raise the dry matter content of the fibre material during the disintegration treatment. The gaseous medium is not included in the calculation of the consistency, which is based on the proportion of the fibres in the pulp, that is, mixture of fibres and liquid.

The disintegration treatment is not prone to clogging even at higher consistencies, compared with methods where the material is pumped through a narrow gap like in a homogenizer, and the principle makes it possible to produce nanofibrillar cellulose in high volumes and in high concentrations. The method can be easily scaled larger, for example by increasing the number of rotors. The treatment can be repeated once or more times for the same batch of fibre material to produce nanofibrillar cellulose with target properties.

The product obtained directly after the disintegration treatment has a high dry matter content that is the same or slightly higher as the initial consistency of the starting fibre material. This decreases or even eliminates the need to raise the dry matter content of the nanofibrillar cellulose product before the transport. Thus, the nanofibrillar cellulose obtained after the treatment can be packed as such and dispatched to the client at high dry matter content. The nanofibrillar cellulose, packed "as such" or dewatered after the treatment is preferably dispatched at a concentration of nanofibrils (based on dry matter of the nanofibrils) which is 20-35 wt-%. The nanofibrillar cellulose taken from the treatment can be dried even to higher nanofibril contents, up to 60 wt-%, before the dispatch. Generally, the nanofibrillar cellulose product can have nanofibrillar content between 16-60 wt-%.

Further, the product obtained after the treatment has, in addition to the high dry matter content, characteristic morphology which can be seen visually. The nanofibrillar cellulose is in the form of moist powder-like material where the fibrils of the nanofibrillar cellulose are gathered to small moist cellulose particles, which may be aggregated due to moisture-dependent stickiness of the particles.

DESCRIPTION OF THE DRAWINGS

In the following, the invention will be described in more detail with reference to the appended drawings, in which.

DETAILED DESCRIPTION OF THE PREFERRED EMBODIMENTS

Fibre Material

Figure 1:
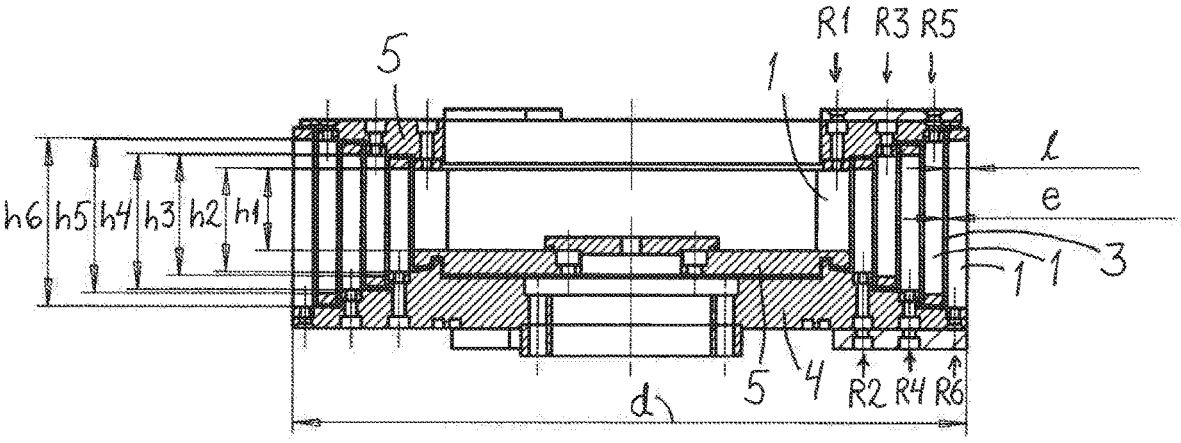
FIG. 1 shows the device used in the invention in a sectional plane A-A coinciding with the axis of rotation of the rotors.

The starting material subjected to the disintegration treatment is fibre raw material which is at a high consistency. The cellulose of the fibre material is chemically modified to high degree to enhance the separation of the fibrils (fibrillation) at high consistency.

The fibre raw material for the chemical modification of cellulose is obtained normally from cellulose raw material of plant origin. The raw material can be based on any plant material that contains cellulosic fibers, which in turn comprise microfibrils of cellulose. The fibers may also contain some hemicelluloses, the amount of which is dependent on the plant source. The plant material may be wood. Wood can be from softwood tree such as spruce, pine, fir, larch, douglas-fir or hemlock, or from hardwood tree such as birch, aspen, poplar, alder, eucalyptus or acacia, or from a mixture of softwoods and hardwoods. Non-wood material can be from agricultural residues, grasses or other plant substances such as straw, leaves, bark, seeds, hulls, flowers, vegetables or fruits from cotton, corn, wheat, oat, rye, barley, rice, flax, hemp, manila hemp, sisal hemp, jute, ramie, kenaf, bagasse, bamboo or reed.

One preferred alternative is fibers form non-parenchymal plant material where the fibrils of the fibers are in secondary cell walls. The fibrils originating in secondary cell walls are essentially crystalline with degree of crystallinity of at least 55%. The source can be wood or non-wood plant material. For example wood fibres are one abundant fibrous raw material source. The raw material can be for example chemical pulp. The pulp can be for example softwood pulp or hardwood pulp or a mixture of these.

The common characteristic of all wood-derived or non-wood derived fibrous raw materials is that nanofibrillar cellulose is obtainable from them by disintegrating the fibers to the level of microfibrils or microfibril bundles.

The modification treatment to the fibers can be chemical or physical. In chemical modification the chemical structure of cellulose molecule is changed by chemical reaction ("derivatization" of cellulose), preferably so that the length of the cellulose molecule is not affected but functional groups are added to β-D-glucopyranose units of the polymer. The chemical modification of cellulose takes place at a certain conversion degree, which is dependent on the dosage of reactants and the reaction conditions, and as a rule it is not complete so that the cellulose will stay in solid form as fibrils and does not dissolve in water. In physical modification anionic, cationic, or non-ionic substances or any combination of these are physically adsorbed on cellulose surface. The modification treatment can also be enzymatic. In enzymatic modification, enzymes that act on cellulose are added to the fibre starting material.

The cellulose in the fibers can be especially ionically charged after the modification, because the ionic charge of the cellulose weakens the internal bonds of the fibers and will later facilitate the disintegration to nanofibrillar cellulose. The ionic charge can be achieved by chemical or physical modification of the cellulose. The fibers can have higher anionic or cationic charge after the modification compared with the starting raw material. Most commonly used chemical modification methods for making an anionic charge are oxidation, where hydroxyl groups are oxidized to aldehydes and carboxyl groups, and carboxymethylation. A cationic charge in turn can be created chemically by cationization by attaching a cationic group to the cellulose, such as quaternary ammonium group.

One preferred modification method is the oxidation of cellulose. In the oxidation of cellulose, the primary hydroxyl groups of cellulose are oxidized catalytically by a heterocyclic nitroxyl compound, for example 2,2,6,6-tetramethylpiperidinyl-1-oxy free radical, "TEMPO". These hydroxyl groups are oxidized to aldehydes and carboxyl groups. Thus, part of the hydroxyl groups that are subjected to oxidation can exist as aldehyde groups in the oxidized cellulose, or the oxidation to carboxyl groups can be complete.

So that the fibre material can be fibrillated at high consistency, the preceding chemical modification of the cellulose must proceed to a sufficiently high level. Fibre material modified by catalytic oxidation has carboxylate content of at least or above 0.8 mmol/g, preferably at least or above 0.95 mmol/g, and most preferably at least or above 1.00 mmol/g, based on weight dried pulp. The carboxylate content is preferably in the range of 0.8-1.8, more preferably 0.95-1.65 and most preferably 1.00-1.55 mmol/g. In fibre material where the cellulose is carboxymethylated, the degree of substitution is above 0.1, preferably at least or above 0.12. The degree of substitution is preferably in the range of 0.12-0.2 in the carboxymethylated cellulose. In fibre material where the cellulose is cationized, the degree of substitution is at least or above 0.1, preferably at least or above 0.15. The degree of substitution is preferably in the range of 0.1-0.6, more preferably 0.15-0.35 in the cationized cellulose.

Cellulose modified physically by adsorbing anionic or cationic substances on cellulose surface contains the adsorbed substances in sufficiently high amounts, 20-1000 mg/g, preferably 40-500 mg/g and most preferably 90-250 mg/g, based on weight of dried pulp. The substances added are preferably water-soluble. For example sodium carboxymethyl cellulose (CMC) is a substance that can be added to make anionically charged physically modified cellulose.

The anionic or cationic substances are preferably adsorbed in an amount corresponding to the preferable amounts of cationization or anionization (chemical modification) which can be expressed as molar equivalents (eq/g or meq/g), that is, in an amount representing the same amount of ionic charge as obtained by chemical modification per 1 g pulp.

Nanofibrillar Cellulose

In this application, nanofibrillar cellulose (NFC) refers to collection of isolated cellulose nanofibrils (also called microfibrils) or nanofibril bundles derived from cellulose based fibre material. Nanofibrillar cellulose has typically a high aspect ratio (length/diameter): the length might exceed one micrometer while the number-average diameter is typically below 200 nm. The diameter of nanofibril bundles can also be larger but generally less than 5 μm. The smallest nanofibrils are similar to so called elementary fibrils, which are typically 2-12 nm in diameter. The dimensions of the fibrils or fibril bundles are dependent on raw material and disintegration method. The nanofibrillar cellulose may also contain some hemicelluloses; the amount is dependent on the plant source. Nanofibrillar cellulose is characterized by a large specific surface area and a strong ability to form hydrogen bonds. In water dispersion, nanofibril cellulose typically appears as either light or almost colourless gel-like material. Depending on the fibre raw material, nanofibrillar cellulose may also contain small amounts of other wood components, such as hemicellulose or lignin. Often used parallel names for nanofibrillar cellulose include nanofibrillated cellulose (NFC), which is often simply called nanocellulose, and microfibrillated cellulose (MFC).

The nanofibrillar cellulose can also be characterized through some rheological values. NFC forms a viscous gel, "hydrogel" when dispersed in water already at relatively low concentrations (1-2 wt-%). A characteristic feature of the NFC is its shear thinning behaviour in aqueous dispersion, which is seen as a decrease in viscosity with increasing shear rate. Further, a "threshold" shear stress must be exceeded before the material starts to flow readily. This critical shear stress is often called the yield stress. The viscosity of the NFC can be best characterized by zero-shear viscosity, which corresponds to the "plateau" of constant viscosity at small shearing stresses approaching zero.

Disintegration Treatment

In this application, the term "disintegration treatment" or "fibrillation" generally refers to comminuting material mechanically by work applied to the particles, which work may be based on various effects, like grinding, crushing or shearing, or a combination of these, or another corresponding action that reduces the particle size. The energy taken by the refining work is normally expressed in terms of energy per processed raw material quantity, in units of e.g. kWh/kg, MWh/ton, or units proportional to these.

The disintegration treatment is performed at a high consistency for the mixture of fibre raw material and water, the fibre suspension. Hereinbelow, the term pulp will also be used for the mixture of fibre raw material and water subjected to the disintegration treatment. The fibre raw material undergoing such treatment may refer to whole fibres, parts separated from them, fibril bundles, or fibrils, and typically the pulp is a mixture of such elements, in which the ratios between the components are dependent on the treatment stage, for example number of runs or "passes" through the treatment of the same batch of fibre material.

Particularly in the case presented in this application, the "disintegration treatment" or "fibrillation" takes place by means of impact energy utilizing a series of frequently repeated impacts. These impacts have varying directions of action because of the construction of the device where the disintegration treatment is performed.

The device shown in FIG. 1 is preferably used in the disintegration treatment where the chemically modified fibre material at high consistency is subjected to repeated impacts at high frequency. The device comprises several counter-rotating rotors R1, R2, R3 . . . placed concentrically within each other so that they rotate around a common rotation axis RA. The device comprises a series of rotors R1, R3 . . . rotating in the same direction, and rotors R2, R4 . . . rotating in the opposite direction, wherein the rotors are arranged pairwise so that one rotor is always followed and/or preceded in the radial direction by a counter-rotating rotor. The rotors R1, R3 . . . rotating in the same direction are connected to the same mechanical rotating means 5. The rotors R2, R4 . . . rotating in the opposite direction are also connected to the same mechanical rotating means 4 but rotating in a direction opposite to the direction of the aforementioned means. Both rotating means 4, 5 are connected to their own drive shaft which is introduced from below. The drive shafts can be located concentrically with respect to the rotation axis RA, for example in such a way that the outer drive shaft is connected to a lower rotating means 4, and the inner drive shaft placed inside it and rotating freely with respect to it, is connected to an upper rotating means 5.

The figure does not show the fixed housing for the device, inside which the rotors are placed to rotate. The housing comprises an inlet, through which material can be supplied from above to the inside of the innermost rotor R1, and an outlet located by the side, oriented approximately tangentially outwards with respect to the peripheries of the rotors. The housing also comprises through-holes for the drive shafts down below.

In practice, the rotors consist of vanes or blades 1 placed at given intervals on the periphery of a circle whose geometric centre is the rotation axis RA, and extending radially.

Figure 2:
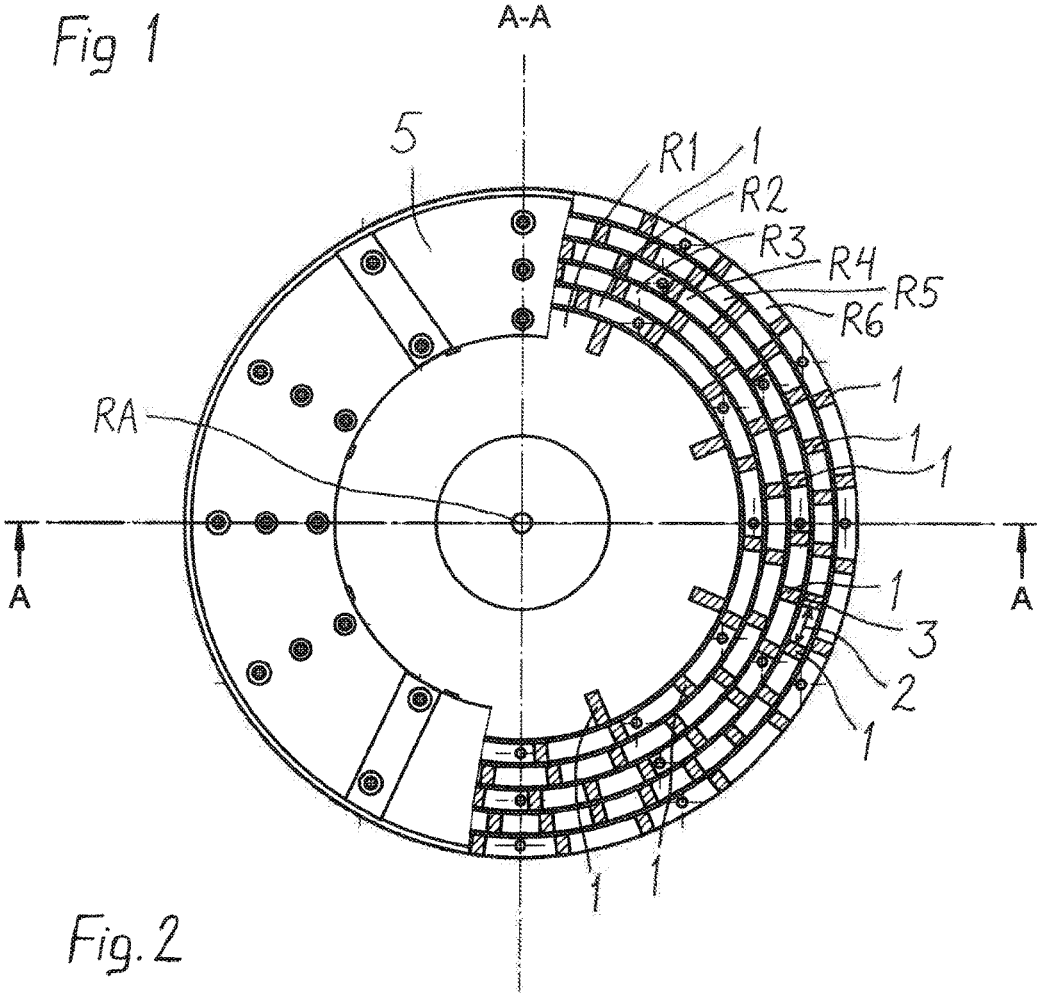
FIG. 2 shows the device of FIG. 1 in a partial horizontal section.

In the same rotor, flow-through passages 2 are formed between the vanes 1, through which passages the material to be refined can flow radially outwards. Between two successive rotors R1, R2; R2, R3; R3, R4; etc., several blade spaces or gaps are formed repeatedly and at a high frequency during the rotary movement of the rotors in the opposite direction. In FIG. 2, reference numeral 3 denotes such blade gaps between the blades 1 of the fourth and fifth rotors R4, R5 in the radial direction. The blades 1 of the same rotor form narrow gaps, i.e. blade gaps 3, with the blades 1 of the preceding rotor (having the narrower radius on the periphery of the circle) in the radial direction and with the blades 1 of the next rotor (placed on the periphery of the circle with the greater radius) in the radial direction. In a corresponding manner, a large number of changes in the impact direction are formed between two successive rotors when the blades of the first rotor rotate in a first direction along the periphery of the circle, and the blades of the next rotor rotate in the opposite direction along the periphery of a concentric circle.

The first series of rotors R1, R3, R5 is mounted on the same mechanical rotating means 5 that consists of a horizontal lower disc and a horizontal upper disc, connected to each other by the blades 1 of the first rotor R1, innermost in the radial direction. On the upper disc, in turn, are mounted the blades 1 of the other rotors R3, R4 of this first series, with the blades 1 extending downwards. In this series, the blades 1 of the same rotor, except for the innermost rotor R1, are further connected at their lower end by a connecting ring. The second series of rotors R2, R4, R6 is mounted on the second mechanical rotating means 4 which is a horizontal disc placed underneath said lower disc, and to which the blades 1 of the rotors of the series are connected, to extend upwards. In this series, the blades 1 of the same rotor are connected at their upper end by a connecting ring. Said connecting rings are concentric with the rotation axis RA. The lower discs are further arranged concentrically by an annular groove and a matching annular protrusion on the facing surfaces of the discs, also placed concentrically with the rotation axis RA and being equally spaced from it.

FIG. 1 shows that the vanes or blades 1 are elongated pieces parallel to the rotation axis R1 and having a height greater than the width I (the dimension in the radial direction). In the horizontal section, the blades are quadrangular, in FIG. 2 rectangular. The fibre material is passed crosswise to the longitudinal direction of the blades, from the centre outwards, and the edges at the sides of the surfaces facing the radial direction in the blades 1 form long and narrow blade gaps 3 extending in the longitudinal direction of the blade, with the corresponding edges of the blades 1 of the second rotor.

The rotors R1, R2, R3 . . . are thus, in a way, through-flow rotors in the shape of concentric bodies of revolution with respect to the rotation axis, wherein their part that processes the fibre material consists of elongated vanes or blades 1 extending in the direction of the rotation axis RA, and of flow-through passages 2 left therebetween.

FIG. 1 also shows that the heights h1, h2, h3 . . . of the rotor blades 1 increase gradually from the first, i.e. the innermost rotor R1 outwards. As a result, the heights of the flow-through passages 2 limited by the rotor blades 1 also increase in the same direction. In practice, this means that when the cross-sectional area of the radial flow increases outwards as the peripheral length of the rotors increases, the increase in the height also increases this cross-sectional area. Consequently, the travel speed of a single fibre is decelerated in outward direction, if the volume flow is considered to be constant.

By the centrifugal force caused by the rotational movement of the rotors, the material to be processed is passed through the rotors with a given retention time.

As can be easily concluded from FIG. 2, during a single whole rotation of a pair of rotors (from a position in which given blades 1 are aligned, to the position in which the same blades 1 are aligned again), several blade gaps 3 are formed when successive blades 1 in the peripheral direction encounter successive blades 1 of the second rotor. As a result, the material transferred through the passages 2 outward in the radial direction is continuously subjected to shear and impact forces in the blade gaps 3 between different rotors and in the flow-through passages 2 between the blades 1 on the periphery of the rotor, when the material is passed from the range of the rotor to the range of an outer rotor, while the movement of the blades in peripheral direction and the directional changes of the movement caused by the rotors rotating in different directions prevent the through-flow of the material too fast out through the rotors by the effect of the centrifugal force. Blade gaps 3 and, correspondingly, encounters of blades 1 and respective changes in the impact directions in two rotors successive in the radial direction are generated at a frequency of [1/s] which is $2\times f_r\times n_1\times n_2$, where $n_1$ is the number of blades 1 on the periphery of the first rotor, $n_2$ is the number of blades on the periphery of the second rotor, and $f_r$ is the rotational speed in revolutions per second. The coefficient 2 is due to the fact that the rotors rotate at the same rotational speed in opposite directions. More generally, the formula has the form $(f_r(1)+f_r(2))\times n_1\times n_2$, where $f_r(1)$ is the rotational speed of the first rotor and $f_r(2)$ is the rotational speed of the second rotor in the opposite direction.

Furthermore, FIG. 2 shows how the number of blades 1 may be different in different rotors. In the figure, the number of blades 1 per rotor increases starting from the innermost rotor, except for the last rotor R6 where it is smaller than in the preceding rotor R5. As the rotational speeds (rpm) are equal irrespective of the location and direction of rotation of the rotor, this means that the frequency at which the blades 3 pass a given point and, correspondingly, the frequency of formation of the blade gaps 3 increases from the inside outwards in the radial direction of the device.

In FIG. 1, the dimension l of the blades in the direction of the radius r is 15 mm, and the dimension e of the blade gap 3 in the same direction is 1.5 mm. Said values may vary, for example from 10 to 20 mm and from 1.0 to 2.0 mm, respectively. The dimensions are influenced by, for example, the consistency of the fibre material to be treated.

The diameter d of the device, calculated from the outer rim of the outermost rotor R6, can vary according to the capacity desired. In FIG. 1, the diameter is 500 mm, but the diameter can also be greater, for example greater than 800 mm. When the diameter is increased, the production capacity increases in a greater proportion than the ratio of the diameters.

It has been found that a decrease in the rotation speed of the rotors impairs fibrillation. Similarly, a decrease in the flow rate (production) clearly improves fibrillation; in other words, the greater the retention time of the material to be processed during which it is subjected to the impact and shear forces of the blades i.e. ribs, the better the fibrillation result.

The cellulose-based fibre material of sufficient modification degree can also be processed to nanofibrillar cellulose at high consistencies with other devices that cause repeated impacts by fast moving successive elongated elements. Such devices include medium-consistency and high-consistency refiners (MC refiners, HC refiners) and the processes are medium-consistency and high-consistency refining, respectively. In these types of refiners fast moving elements are bars on the opposite refining surfaces and the fibrillation takes place in gaps formed between the bars during bar crossings (as the opposite bars pass each other), due to the relative rotation movement of the opposite refining surfaces (rotor and stator). Conical refiners and disc refiners are common types of such refiners.

In the above described process, the fibre material to be processed for producing nanofibril cellulose is a mixture of water and cellulose based fibres which have been separated from each other in the preceding manufacturing processes of mechanical pulp or chemical pulp, where the starting material is preferably wood raw material. In the manufacture of nanofibrillar cellulose, it is also possible to use cellulose fibres from other plants, where cellulose fibrils are separable from the fibre structure. The fibres obtained from any of the above-mentioned sources are then subjected to the chemical modification. A suitable consistency of the high-consistency pulp to be fibrillated is over 10 wt-%, preferably at least 15 wt-%. The preferable consistency ranges are higher than 10 wt-% and 50 wt-% at the most, especially 15-50 wt-%, more preferably 15-40 wt-%, and most preferably 15-30 wt-%. The liquid medium where the fibre material is suspended to the desired consistency is preferably aqueous medium. It is also possible that the material is fibre material that has already passed the same process once or more times, and from which fibrils have already been separated. When the material is already partly fibrillated as a result of the preceding processing runs, it tends to become more or less "sticky", but it can still be treated at the same high consistency or concentration in the device because of the robust structure of the device which is not sensitive to the material properties. Fibre material at a given consistency in water is supplied in the above-described way through the rotors R1, R2, R3 . . . until it has reached the desired degree of fibrillation, which can be seen as viscosity values and shear-thinning behaviour typical of nanofibrillar cellulose when the product is diluted to form a gel. If necessary, the processing is repeated once or several times by running the material through the rotors again, or through another similar series of rotors, wherein the device comprising two or more of the above described sets of rotors can be coupled in series.

As the final result, the product obtained after several refining runs exists as moist powdery material where the fibrils of the nanofibrillar cellulose are gathered to moist particles or granules which can be distinguished visually. The particle size is 0.1-1 mm. These particles can be aggregated to larger granular aggregates due to the stickiness of the moist particles, depending on the moisture of the product. The number-based median diameter (d50) of the particles is 100-1000 μm, preferably 150-500 μm, as gently dispersed in water to separate the particles and measured by laser-diffraction particle-size analyzer. The product is also characterized by the same chemical structure and degree of modification of the cellulose as the fibre material used as the starting material, which can be expressed as amount of chemical groups or equivalents/g nanofibrillar cellulose (dry matter) or as degree of substitution (DS). The product after the disintegration of the pulp can be dried further, or packed as such, that is, at the water content at which it exits the disintegration treatment.

By the above-presented method, it is possible to obtain nanofibrillar cellulose product, in which the viscosity of an aqueous dispersion made of the product increases as a function of the specific energy (energy consumption), that is, as the specific energy used for the fibrillation increases. Consequently, the viscosity of the diluted product and the specific energy used in the method have a positive correlation. It has also been found that nanofibrillar cellulose can be obtained, whereby the turbidity and the content of fibre particles reduces as a function of specific energy (energy consumption).

Typically in the method, the aim is to obtain, as the final product, nanofibrillar cellulose product whose Brookfield viscosity, measured at a consistency of 0.8% (10 rpm), is at least 5,000 mPa·s, for example between 5,000 and 20,000 mPa·s. In addition to the high viscosity, the aqueous nanofibrillar cellulose dispersions obtained by diluting the product are also characterized by so-called shear thinning; that is, the viscosity decreases as the shear rate increases.

Furthermore, the aim is to obtain nanofibrillar cellulose whose turbidity is typically lower than 80 NTU, advantageously from 10 to 60 NTU, at a consistency of 0.1 wt-% (aqueous medium), measured by nephelometry.

Furthermore, the aim is obtain shear thinning nanofibril cellulose having a zero shear viscosity ("plateau" of constant viscosity at small shearing stresses) in the range of 1,000 to 50,000 Pa·s and a yield stress (shear stress where shear thinning begins) in the range of 1 to 50 Pa, advantageously in the range of 3 to 20 Pa, preferably 6-15 Pa, measured at a consistency of 0.5 wt-% (aqueous medium).

EXAMPLES

In the following, the method is described by some examples which do not restrict the method.

Examples—Production of Nanofibrillar Cellulose in High Consistency

Cellulose birch pulp was anionically modified by "TEMPO" oxidation. Two modification levels: 0.77 mmol COOH/g pulp (22% dry solids) and 1.07 mmol COOH/g pulp (18% dry solids). The carboxylate content was determined by conductometric titration.

Reference Example (REF)

The anionic pulp (1.07 mmol COOH/g pulp) was dispersed to water to form 2.5% (w/w) dispersion. The dispersion was fed into a homogenizer (GEA Niro Soavi Panther) at 600 bar. As a result, viscous nanofibrillar cellulose gel was formed.

Comparative Example

Anionic pulp (0.77 mmol COOH/g) in high consistency (starting consistency 22%) was run 3 times through a disperser (Atrex), through its series of counterrotating rotors. The disperser used had a diameter of 850 mm and rotation speed used was 1800 rpm. As a result, moist cellulose powder-like product was obtained.

Example 1

Anionic pulp (1.07 mmol COOH/g) in high consistency (starting consistency 18%) was run 3 times through a disperser (Atrex), through its series of counterrotating rotors. The disperser used had a diameter of 850 mm and rotation speed used was 1800 rpm. As a result, moist cellulose powder-like product was obtained.

Example 2

Anionic pulp (1.07 mmol COOH/g) in high consistency (starting consistency 18%) was run 3 times through a disperser (Atrex), through its series of counterrotating rotors. The disperser used had a diameter of 850 mm and rotation speed used was 1800 rpm. After that, formed cellulose powder was dispersed to water to form 3.0% (w/w) dispersion. The dispersion was run 1 pass through the Atrex device. As a result, viscous nanofibrillar cellulose gel was formed.

To verify the success of fibrillation, rheological measurements of the product in the form of nanofibrillar cellulose hydrogels were carried out with a stress controlled rotational rheometer (ARG2, TA instruments, UK) equipped with four-bladed vane geometry. Samples were diluted with deionised water (200 g) to a concentration of 0.5 w % and mixed with Waring Blender (LB20E*, 0.5 L) 4×10 sec (20 000 rpm) with short break between the mixing. Rheometer measurement was made for the sample. The diameters of the cylindrical sample cup and the vane were 30 mm and 28 mm, respectively, and the length was 42 mm. The steady state viscosity of the hydrogels was measured using a gradually increasing shear stress of 0.001-1000 Pa. After loading the samples to the rheometer they are allowed to rest for 5 min before the measurement is started. The steady state viscosity is measured with a gradually increasing shear stress (proportional to applied torque) and the shear rate (proportional to angular velocity) is measured. The reported viscosity (=shear stress/shear rate) at a certain shear stress is recorded after reaching a constant shear rate or after a maximum time of 2 min. The measurement is stopped when a shear rate of 1000 s−1 is exceeded. The method is used for determining zero-shear viscosity.

Figure 3:
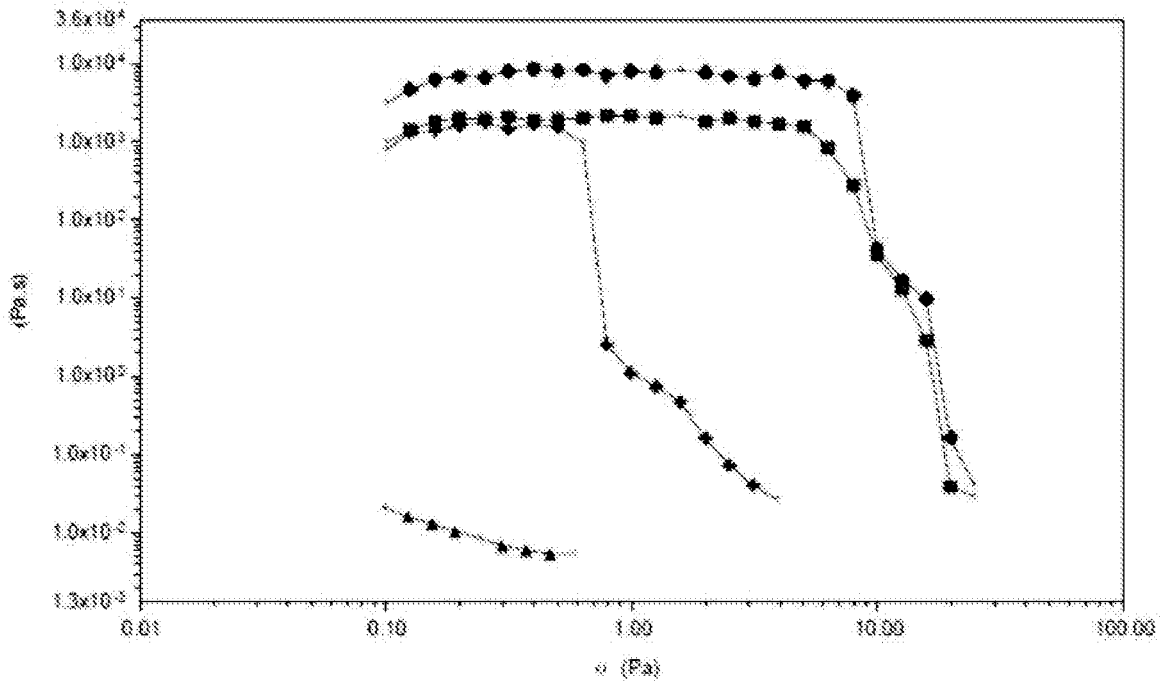
FIG. 3 shows viscosity of various product samples.

Viscosity as a function of shear stress for the four nanofibrillar cellulose product samples in 0.5% dilution are presented in FIG. 3. As can be seen from the results, the sample with high degree of modification, where the carboxylate group content was above 1.00 mmol COOH/g pulp (1.07 mmol COOH/g) reached even higher zero-shear viscosity values (over 2000 Pa·s) as the reference which was prepared at low consistency (2.5%), whereas the sample with lower degree of modification (carboxylate content below 0.8 mmol/g pulp) had very low viscosity values with no distinguishable yield point (yield stress value).

Particle Size

Particle size of moist cellulose powder of Example 1 was measured by Beckman Coulter LS320 (laser-diffraction particle size analyzer). 4 g of the powder was dispersed to 500 ml of water with hand mixer. Particles were fed into particle analyser until there were enough particles in a circulation. Water was used as a background liquid. Coulter LS Particle size Median diameter, 292 μm was measured. (Note: due to high solid fibrillation, nanofibrils are in the form of aggregated granules. For particle size analysis, these aggregated granules are dispersed by gentle mixing only; to make nanofibrillar cellulose for rheological measurement and before the use, powerful dispergation is needed.

Turbidity

Turbidity of samples was measured at 0.1 wt-% by nephelometry.

In the method, a nanofibrillar cellulose sample is diluted in water, to the measuring concentration of 0.1 wt-%. HACH P2100 Turbidometer with a 50 ml measuring vessel is used for turbidity measurements. The dry matter of the nanofibrillar cellulose sample is determined and 0.5 g of the sample, calculated as dry matter, is loaded in the measuring vessel, which is filled with tap water to 500 g and vigorously mixed by shaking for about 30 s. Without delay the aqueous mixture is divided into 5 measuring vessels, which are inserted in the turbidometer. Three measurements on each vessel are carried out. The mean value and standard deviation are calculated from the obtained results, and the final result is given as NTU units (nephelometric turbidity units). The characteristics of the samples obtained from the examples 1 and 2 were as follows:

Example 1 24 NTU

Example 2 19 NTU

Thanks to its rheological properties, fibril strength properties, as well as the translucency of the products made from it, the nanofibril cellulose obtained by the method can be applied in many uses, for example as a rheological modifier and a viscosity regulator, and as elements in different structures, for example as a reinforcement. Nanofibril cellulose can be used, among other things, in oil fields as a rheological modifier and a sealing agent. Similarly, nanofibril cellulose can be used as an additive in various medical and cosmetic products, as reinforcement in composite materials, and as an ingredient in paper products. This list is not intended to be exhaustive, but nanofibril cellulose can also be applied in other uses, if it is found to have properties suitable for them.

The invention claimed is:

1. A method for producing nanofibrillar cellulose, wherein cellulose based fibre material, in which internal bonds in cellulose fibres have been weakened by preliminary chemical modification of cellulose, is subjected to disintegration treatment in form of pulp suspension comprising fibres and liquid wherein the fibre material supplied to the disintegration treatment has one of the following properties:

oxidized cellulose having carboxylate content of at least 0.8 mmol/g pulp or higher, carboxymethylated cellulose having degree of substitution above 0.1, or cationized cellulose having degree of substitution of at least 0.1 or higher, said method comprising:

supplying the pulp suspension at a consistency higher than 10 wt-% based on the proportion of the fibres in the pulp suspension and having a content of gas of greater than 10 volume percent, to a disintegration treatment detaching fibrils from the fibre material in course of said disintegration treatment by joint effect of repeated impacts to the fibre material by fast moving successive elements and the weakened internal bonds of the cellulose fibres, wherein the fibre material is subjected to repeated impacts successively from opposite directions; and withdrawing the nanofibrillar cellulose from the disintegration treatment at dry matter which is equal or higher than the consistency of the fibre material.

2. The method according to claim 1, wherein the fibre material is supplied at a consistency of higher than 15 wt-% and 50 wt-% at most.

3. The method according to claim 1, wherein the cellulose in the fibre material supplied to the disintegration treatment is ionically charged cellulose.

4. The method according to claim 3, wherein the fibre material supplied to the disintegration treatment has the following properties:

cellulose modified physically by adsorbing anionic or cationic substances on cellulose surface in an amount of 20-1000 mg/g.

5. The method according to claim 3, wherein the fibre material supplied to the disintegration treatment has the following properties:

oxidized cellulose having carboxylate content of 0.8-1.8 mmol/g pulp, carboxymethylated cellulose having degree of substitution of 0.12-0.2, or cationized cellulose having degree of substitution of 0.1-0.6.

6. The method according to claim 1, wherein the cellulose in the fibre material supplied to the disintegration treatment is enzymatically modified cellulose.

7. The method according to claim 1, wherein the disintegration treatment, the fibre material is supplied through several counter-rotating rotors (R1, R2, R3 . . . ) outwards in the radial direction with respect to the rotation axis (RA) of the rotors in such a way that the material is repeatedly subjected to shear and impact forces by the effect of the blades (1) of the different counter-rotating rotors, whereby it is simultaneously fibrillated, wherein the fibrillation is effected by means of impact energy utilizing a series of frequently repeated impacts having varying directions of action caused by several successive impacts from opposite directions.

8. The method according to claim 1, wherein the disintegration treatment is continued until the nanofibrillar cellulose withdrawn from the disintegration treatment has achieved a zero shear viscosity of 1,000 to 50,000 Pa·s and a yield stress of 1 to 50 Pa when measured at a consistency of 0.5%.

9. The method according to claim 1, wherein the fibre material in form of pulp is subjected to the disintegration treatment together with a gaseous medium.

10. The method according to claim 1, wherein the nanofibrillar cellulose is packed and delivered in the same dry matter content as it was withdrawn from the disintegration treatment.

11. The method according to claim 10, wherein the dry matter content of the nanofibrillar cellulose, based on the dry matter of nanofibrils, is 16-60 wt-%.

12. The method according to claim 1, wherein after the nanofibrillar cellulose has been withdrawn from the disintegration treatment, its dry matter content is raised, and the nanofibrillar cellulose is packed and delivered in a higher dry matter content than the dry matter content in which it was withdrawn from the disintegration treatment.

13. The method of claim 1, wherein the internal bonds in the cellulose fibres have been weakened by a preliminary chemical modification of cellulose.

14. The method according to claim 1, wherein the fibre material is supplied at a consistency of 15-40 wt-%.

* * * * *